US006634728B1

(12) United States Patent
Leguin

(10) Patent No.: US 6,634,728 B1
(45) Date of Patent: Oct. 21, 2003

(54) DEVICE FOR DETACHABLY FIXING OBJECTS

(76) Inventor: Hermann Leguin, Ravensburger Strasse 28, D-88279 Amtzell (DE)

( * ) Notice: Subject to any disclaimer, the term of this patent is extended or adjusted under 35 U.S.C. 154(b) by 0 days.

(21) Appl. No.: 09/462,991

(22) PCT Filed: Jul. 17, 1998

(86) PCT No.: PCT/EP98/04419

§ 371 (c)(1),
(2), (4) Date: Apr. 17, 2000

(87) PCT Pub. No.: WO99/03648

PCT Pub. Date: Jan. 28, 1999

(30) Foreign Application Priority Data

Jul. 17, 1997 (DE) ..... 297 12 619
May 25, 1998 (DE) ..... 198 22 972

(51) Int. Cl.[7] ..... A47B 88/04
(52) U.S. Cl. ..... 312/348.3; 312/351
(58) Field of Search ..... 312/333, 351, 312/348.3, 902; 108/53.1; 211/194; 206/507

(56) References Cited

U.S. PATENT DOCUMENTS 1,900,148 A * 3/1933 Wood ..... 211/50
4,056,027 A * 11/1977 Northrop ..... 83/455
4,285,556 A * 8/1981 Loeffel ..... 312/244
4,709,970 A * 12/1987 Savoie ..... 312/140.4
4,782,619 A * 11/1988 Richards ..... 312/902
4,979,612 A * 12/1990 Melbye ..... 206/216
5,211,458 A * 5/1993 Yale ..... 312/193
5,452,803 A * 9/1995 Stromberg ..... 206/507
5,484,092 A * 1/1996 Cheney ..... 312/902
5,556,180 A * 9/1996 Miller et al. ..... 312/193
6,173,580 B1 * 1/2001 Rosenburg ..... 62/407

FOREIGN PATENT DOCUMENTS

DE 29602136 U * 6/1997
EP 0337840 A * 10/1989
FR 1332674 A * 12/1963
FR 2254193 A * 8/1975 ..... B42F/1/00

* cited by examiner

*Primary Examiner*—Lanna Mai
*Assistant Examiner*—Jerry A. Anderson
(74) *Attorney, Agent, or Firm*—Bachman & LaPointe, P.C.

(57) ABSTRACT

The invention relates to a device for accommodating objects, in particular receptacles (12 to 12.11) in which tools or tool parts are sorted and kept, on a bottom part (8) in particular of a drawer. A support (9) is fitted between the object (12 to 12.5, 12.9) and the bottom part (8). Said support has elements (11) for fixing the object (12).

15 Claims, 6 Drawing Sheets

DEVICE FOR DETACHABLY FIXING OBJECTS

BACKGROUND OF THE INVENTION

The invention relates to a device for the releasable securing of containers for the sorted storage of tools and/or tool parts, on a base of, in particular, a drawer, the base itself or an underlay arranged between the container and the base possessing securing elements or recesses for fixing the container, and the container base possessing counter-elements for these securing elements or recesses.

In many cases in everyday life and in industrial sectors, articles are used which are sorted. Although reference is primarily made below to tools and/or tool parts, the present invention is not intended to be restricted thereto. It applies to a very large number of articles.

FR-A 2 254 193 and U.S. Pat. No. 5,556,180 have disclosed, for example, card-index boxes in which index cards or even files can be stacked obliquely. The same also applies to U.S. Pat. No. 1,900,148.

For tools, tool chests are known, such as are described, for example, inter alia in U.S. Pat. No. 4,285,556. These tool chests possess pegboards, into the holes of which hooks can be inserted. These hooks then serve to retain the corresponding tools.

If, for example, articles are laid in drawers, those articles move, often to an undesirable extent, when the drawers and opened and closed. This applies in particular to the above-mentioned tools, such as drills, milling cutters, etc, which are sorted by size or other particular parameters. Thus, known tool chests already include containers with depressions or the like in which these tools lie. In most cases, however, these tool chests are arranged far from a machine in which these tools are used. In other words, the user firstly locates the tool in the tool chest and then fits that tool to the machine. If he discovers at the machine, however, that the tool is not the right tool, he must return to the tool chest and fetch, for example, a tool of a different diameter. This takes time and is undesirable.

U.S. Pat. No. 5,211,458 has in turn disclosed a chest in which two drawers are provided. Inserted into the upper drawer is an underlay from which obliquely positioned strips project downward, on which, for example, a container can be placed which in turn possesses channels on the base side. The container serves, for example, to receive files.

U.S. Pat. No. 4,709,970 has disclosed an arrangement in which measuring instruments are secured on a perforated base. The securing is provided by angular plug-in frames.

The object of the present invention is to provide a device of the type referred to above with which the containers can be kept cleanly sorted and do not become mixed up, and in which the user can take a plurality of required containers with him.

SUMMARY OF THE INVENTION

The foregoing object is achieved in that pegs, as securing elements, or the recesses are arranged symmetrically and at a uniform distance apart on the base or underlay, and in that either projections projecting downwards from the container base are inserted between the pegs or into the recesses or recesses are molded into the container base, into which the pegs engage.

This means that the container no longer slides backwards and forwards on the base of, for example, a drawer, thus creating the risk that containers will become mixed up. In the simplest example of embodiment, the elements of the base or underlay can also engage into one another for securing purposes. Thus, a part could be cut off from the underlay and adhesively bonded to a container, the elements projecting downwards from the container. The container is then placed on the underlay, the elements engaging into one another. This is designed, in particular, for a pocket calculator, a gauge block or a weight box.

The containers possess individual depressions or compartments which are formed, in each case, in accordance with the design of the article. If, for example, drills are stored, the container should consist of an integral injection molding in which elongate depressions with rounded-off depression walls are molded. This also greatly facilitates the removal of the drill, which can be pushed out of the depression with one finger.

An essential part of the present invention is the design of the base or of the abovementioned underlay. For example, this underlay may be a plate-shaped element which is laid in, for example, a drawer of a tool chest. The disadvantage here is that drawers of tool chests are not standardized and may be of different sizes, so that often one part of the drawer base is not covered by the plate-shaped element. For this reason, in a preferred example of embodiment of the present invention, a flexible material, preferably capable of being rolled up, is used for the underlay. The preferable material here is a plastic, which can be rolled up to form a roll. The user then merely needs to unroll a section from the roll to suit the size of the drawer and cut it off, so that he can line the drawer completely with the underlay, as is preferable.

As a connecting element, many designs are suitable. In the simple example of embodiment, projections are provided on the underlay which interact with corresponding container walls and/or recesses and/or projections in or on the container or the container base. The projections of the underlay may be LEGO-type cylindrical plugs on which or between which the container is laid.

Conversely, however, it is also possible to form recesses in the underlay into which downward projections from the container base then engage. For example, these projections may be spherical elements which then, in the position of use, rest in a corresponding cup-shaped depression.

In a preferred example of embodiment, annular projections project downward from the container base and, when the container is placed on the underlay, engage between four pegs. The actual mounting of the container on the underlay is provided, however, by peripheral side walls, so that the projections on the container base may actually be dispensed with. The side walls enclose a receiving window which is so designed that it extends tangentially around corresponding pegs on the underlay.

Should annular projections exist between the side walls of the container, these preferably do not extend beyond the lower marginal edge of the side walls, so that the container stands on the outer side walls even if the underlay is removed.

The advantage of this design is that not merely an article from the container but the whole container can be removed from the drawer with a large number of sorted tools and transported to the machine. The selection is then made at the machine to determine which tool is specifically required. Considerable movement is saved by this.

With many tools, the containers do not need to be very thick in shape, so that a plurality of containers can also be stacked one above the other in a drawer. In order that these should likewise be secured in the drawer, the surface of the container will again be provided with projections or recesses into which downward projections from the container base or recesses molded into the container base then engage.

In a preferred example of embodiment of the invention, the projections are distributed over the marginal edges of the containers in such a way that any desired variant of stackability is possible. Many conceivable possibilities exist for this, and the present invention is intended to, encompass them. Furthermore, the projections on the marginal edges of the containers preferably form a different system from the securing system of the underlay or the base.

The overall arrangement of the projections and recesses is selected so that the containers can be placed in a drawer not only in one alignment but also in the alignment rotated through 90° relative thereto. Accordingly, the projections and recesses are symmetrically arranged. This also applies, naturally, to the projections or recesses on the surface or marginal edge of each container.

Furthermore, the possibility has also been considered of arranging the projections and recesses in particular configurations so that only containers from a particular manufacturer can be used. The same also applies to a diameter of the projections and recesses and to their height or depth. Also, projections could be used that are larger in the lower region or the recesses could be made larger so that they can be more easily located by the projections when the containers are inserted.

In some cases, it is also important for the underlay to be adapted to a drawer size or the like. In these cases, it may become necessary for a section to be cut off from the underlay and, possibly, placed at another point in the drawer. A special cutting aid is provided for this cutting-off operation, which greatly facilitates it in a simple manner. In the preferred example of embodiment, the cutting aid consists of a strip whose width approximately corresponds to the distance apart of the pegs on the underlay. The strip contains a slit into which a cutting tool can be inserted.

The strip can now be passed between the pegs, together with the cutting tool, so that the cutting tool remains in line. The section to be cut off is then broken, for example, over the edge of a table.

In a preferred example of embodiment, the cutting aid is also simultaneously designed as a template for matching a connection piece to the underlay. The pegs of the connecting piece should be aligned with the pegs of the underlay so that precise positioning of the containers can be achieved.

Also provided on the strip for this purpose is a cover strip in which marginal depressions are formed which maintain a distance apart from one another corresponding to the distance between the pegs on the underlay.

In order to enable this cutting aid and template to be usable for both functions, the strip of the cutting aid should possess a height at least corresponding to the height of the pegs on the underlay. If the cutting aid is then used as a cutting aid, the cover strip passes over the pegs. If the cutting aid is used as a template, it merely needs to be twisted so that the pegs engage into the depressions.

For some examples of application, it has proven advisable to form the container from a plurality of parts so that its length is matched to an article to be received. Therefore, for example, the container consists of two end pieces between which one middle piece is provided. This middle piece is matched to the length of the article. A plurality of middle pieces may also be provided.

To identify the inserted articles, an indicator should preferably be assigned to the container. This indicator can also display the state of wear of the inserted articles, as is described for example in DE 296 02 136 U1.

In a simple example of embodiment, a plate has hook-shaped extensions whereby it is hooked into an upper marginal edge of the side wall of the container. In order to prevent the plate being lost, these hook-shaped projections should possess barbs. If the plate is to be removed or replaced, it is merely necessary to lift the plate so that a predetermined breaking point, provided between the plate and the hook-shaped extension, breaks.

BRIEF DESCRIPTION OF THE DRAWINGS

Further advantages, features and details of the invention are apparent from the description of preferred examples of embodiment given below and with reference to the drawings, in which.

DETAILED DESCRIPTION

Figure 1:
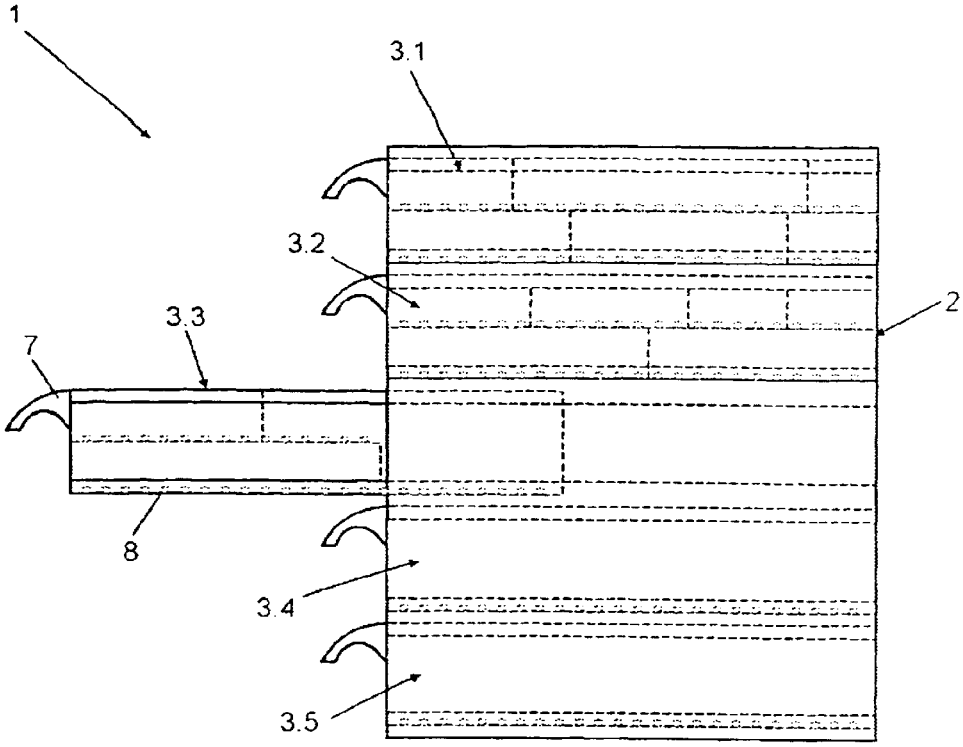
FIG. 1 shows a lateral view of a tool chest which contains a device according to the invention for receiving articles.

According to FIG. 1, a tool chest 1 possesses a housing 2 in which a plurality of drawers 3.1 to 3.5 are removably arranged. A corresponding drawer 3 is shown in detail in FIG. 2.

The drawer 3 possesses a front wall 4, a rear wall 5 and two side walls 6.1 and 6.2. A handle 7 is arranged on the front wall 4. Furthermore, the front wall 4, rear wall 5 and side walls 6.1 and 6.2 enclose a base 8.

Figure 2:
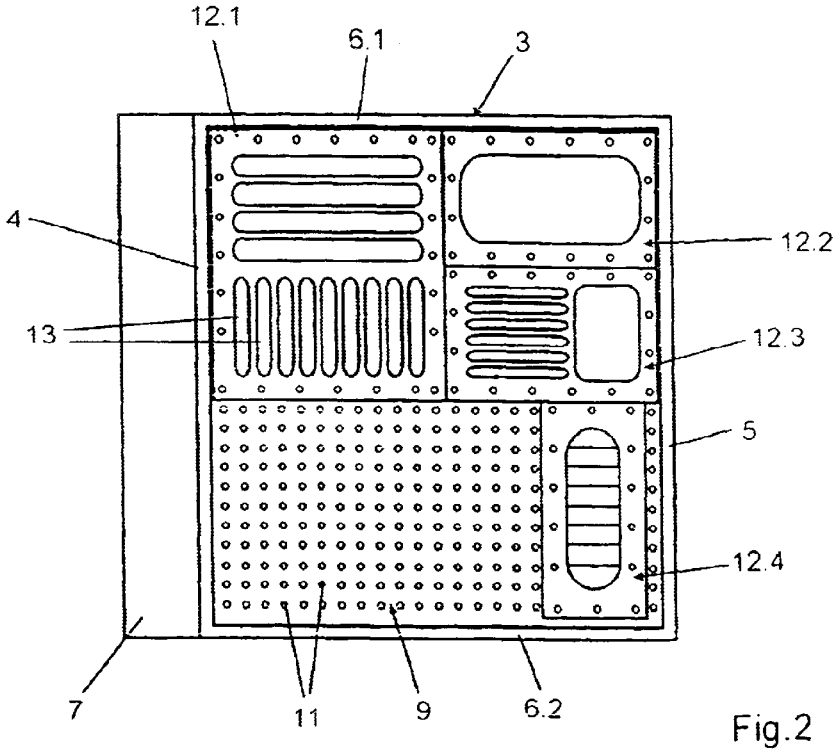
FIG. 2 shows a plan view of an opened drawer of the tool chest according to FIG. 1.
Figure 3:
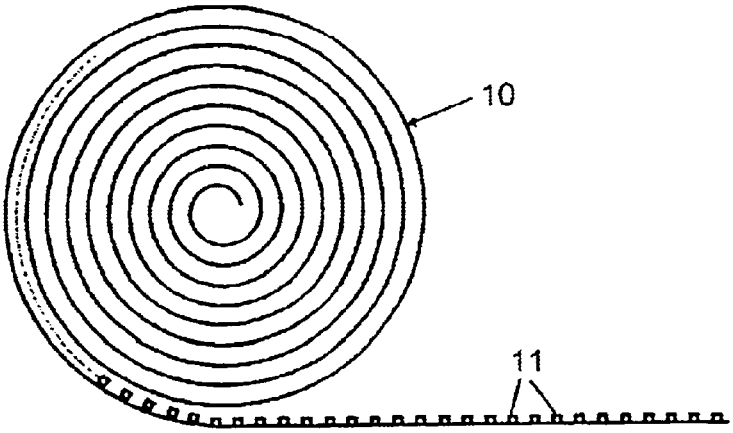
FIG. 3 shows a lateral view of a rolled-up underlay for use in a drawer according to FIG. 2.

On the base 8 lies an underlay 9 which, according to FIG. 2, is of plate-shaped design. However, it is also within the scope of the invention for the underlay 9 to be capable of being cut off from an underlay roll 10, as is shown in FIG. 3. It is thus possible to adapt the underlay 9 to the outline of the base 8.

According to the invention, projections 11 rise from the underlay 9 and may be of any desired geometrical shape. Preferably, they are designed as cylindrical plugs or pegs. It is also conceivable that, instead of or in addition to the projections 11, recesses are formed in the underlay 9 which serve the same purpose.

Containers 12 for receiving articles, especially tools, are inserted into the drawer 3. FIG. 2 shows four such containers, 12.1 to 12.4. Each container possesses compartments 13, into which the corresponding tools or other articles can be inserted. FIG. 2 shows that these containers 12.1 to 12.4 may also be of different sizes. Preferably, however, they are so designed that they can be distributed symmetrically in the drawer 3.

Figure 5:
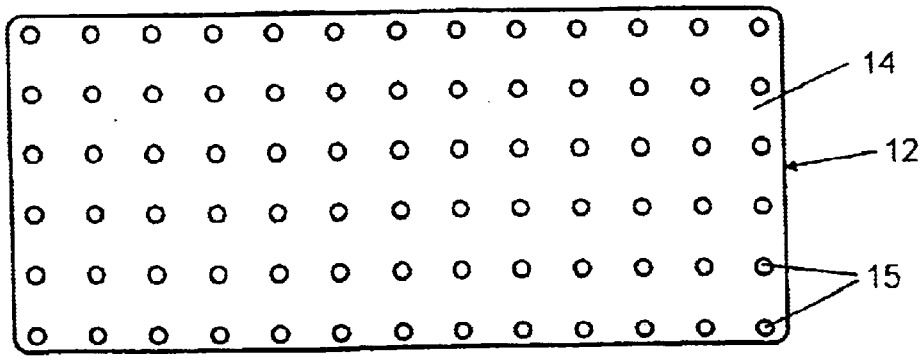
FIG. 5 shows a view from below of the container according to FIG. 4.

According to FIG. 5, each container 12 possesses recesses 15 on its container base 14, a large number of such recesses being shown according to FIG. 5. It is self-explanatory that far fewer recesses are also sufficient, provided that the distribution is symmetrical. Instead of the recesses 15, which interact with the projections 11, projections could also project downward from the container base 14 and engage into corresponding recesses in the underlay 9.

Figure 4:
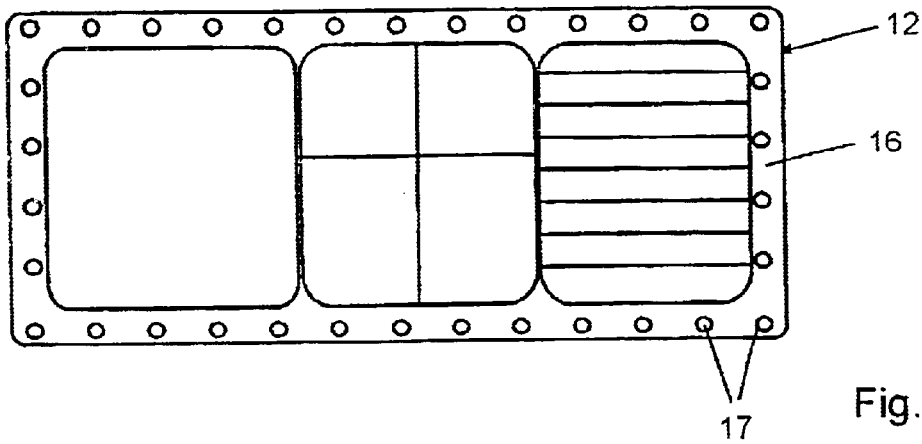
FIG. 4 shows a plan view of a container according to the invention

On its surface also, which according to FIG. 4 is designed as marginal edge 16, the container 12 possesses projections 17 which can interact with corresponding recesses 15 in the container base 14 of another container. Here again, corresponding recesses may be provided instead of the projections 17, into which recess corresponding projections projecting downwards from the container base 14 can then engage.

Instead of the projections and recesses, the corresponding connection between container and underlay could also be provided by magnets.

The mode of functioning of the present invention is as follows:

First, an underlay 9 is cut off from an underlay roll 10 and fits into a drawer 3. A desired number of containers 12 is then placed in this drawer 3 on the underlay 9, the projections 11 of the underlay 9 engaging into the corresponding recesses in the container base 14. As a result, the container 12 is secured against sliding in the drawer 3.

As soon as the drawer 3 is essentially filled with containers 12, a second layer of containers may also be stacked on the first layer, and here again corresponding projections 17 projecting upward from the surface of the containers 12 engage into corresponding recesses 15 of the overlying container 12.

If, for example, a particular type of tool is desired, that container which contains these tools, though of different sizes, can be removed from the drawer 3 and brought to the machine. This has the advantage that the full selection of desired tools of a particular type is available at the machine, so that no attention needs to be paid to the size of this tool when searching in the drawer.

In a preferred example of embodiment of the invention according to FIGS. 6 to 9, the underlay 9 is of plate-shape design. From it, the cylindrical pegs 11 project upward at regular distances apart, each set of four pegs forming a free space to receive a ring 18 projecting from the container base 14.1. This container base 14.1 is part of a container depression 20 which is connected via reinforcing webs 21 to side walls 19.1 to 19.4.

Figure 6:
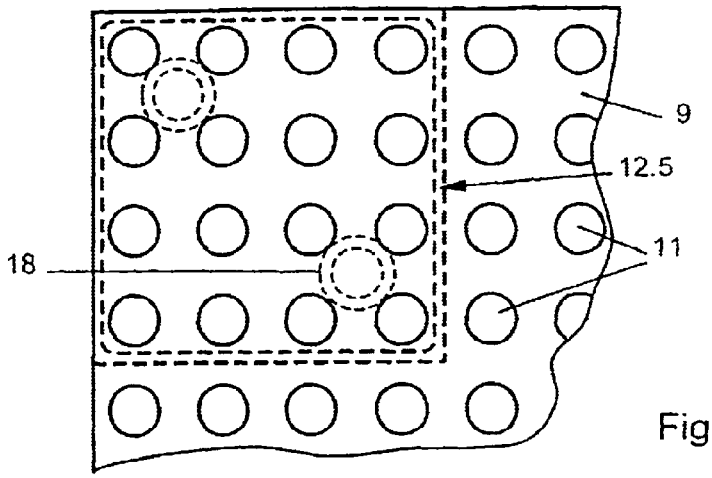
FIG. 6 shows a plan view of one part of a further example of embodiment of an underlay according to the invention.
Figure 7:
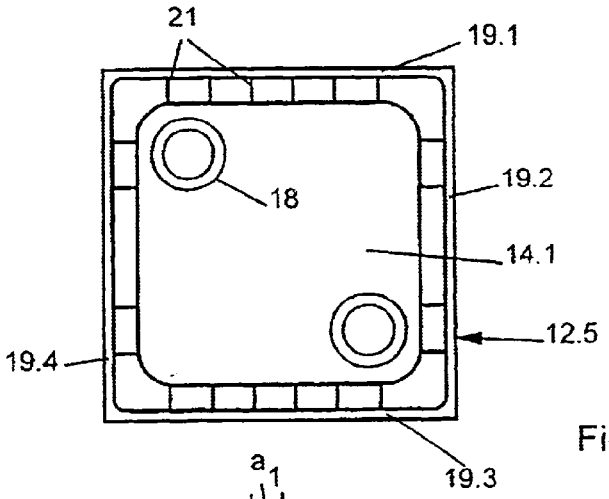
FIG. 7 shows a view from below of a further example of embodiment of a container.

The broken lines in FIG. 6 show how the container 12 rests on the underlay 9. It can be seen that each of the rings 18 is seated between four pegs 11. It can also be seen that the side walls 19.1 to 19.4 extend around a plurality of pegs 11, so that the container 12 is retained by the interaction of rings 18 and the side walls 19.1 to 19.4 with the pegs 11.

Figure 8:
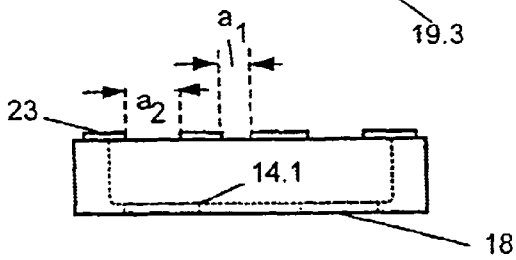
FIG. 8 shows a lateral view of the container according to FIG. 7.

FIG. 8 shows that the rings 18 do not project above the plane of the lower marginal edges 22 of the side walls 19.1 to 19.4, so that the container rests on these lower marginal edges 22. As a result, the stability of the container 12 is greatly improved.

The large intervening spaces between the pegs 11, which can be seen in FIG. 6, additionally permit easy cleaning of the underlay 9. Furthermore, the pegs 11 are preferably produced by deep drawing, the underlay 9 in this case, which is likewise preferred, being produced from plastic.

The arrangement of the rings 18 in the position of use between pegs 11 also has the advantage that the rings 18 need not be arranged too close to the side walls 19.1 to 19.4, which in turn has advantages as regards stability.

Figure 9:
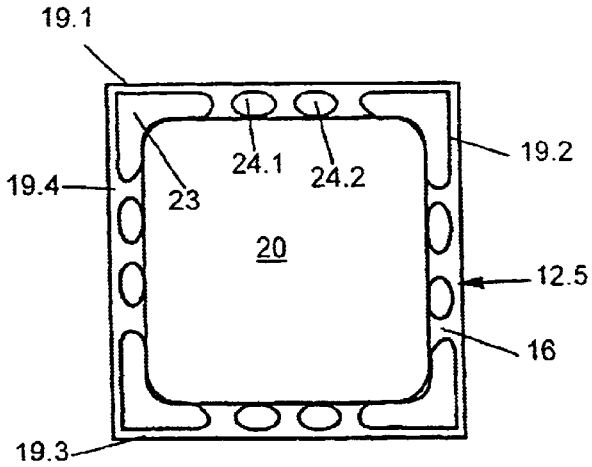
FIG. 9 shows a plan view of the container according to FIG. 7.

FIGS. 8 and 9 show crenellation-like projections on the marginal edges 16 of the container 12.5. Corner crenellations 23 are provided in the corner regions, a pair of crenellations 24.1/24.2 extending between two corner crenellations 23. In this case, a distance a1 between the crenellations 24.1 and 24.2 of a pair of crenellations should be smaller than a distance a2 between the pair of crenellations 24.1/24.2 and a corner crenellation.

Figure 10:
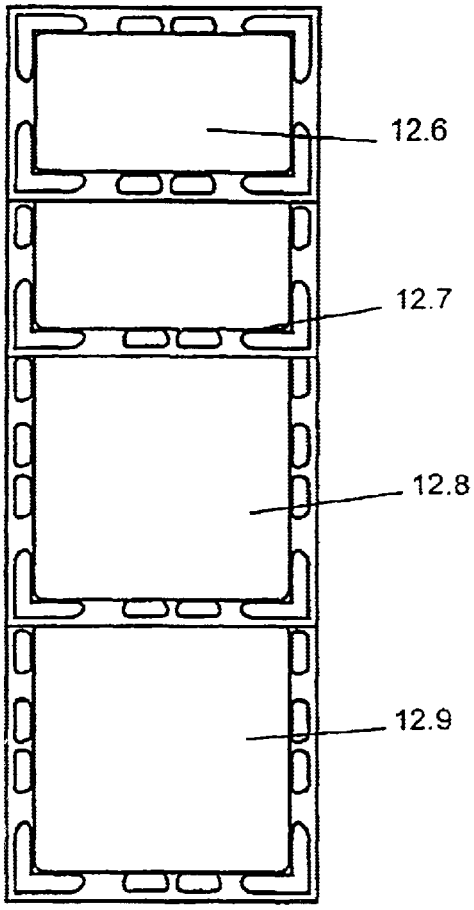
FIG. 10 shows a plan view of a plurality of containers stacked one o the other.
Figure 11:
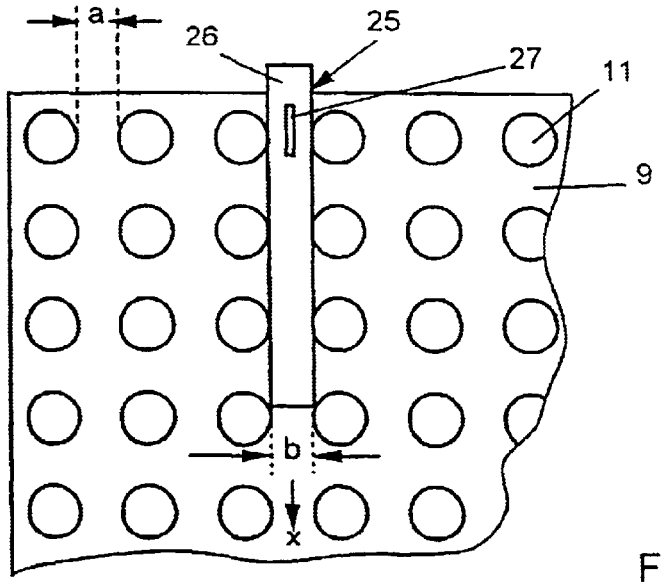
FIG. 11 shows a plan view of one part of an underlay according to the invention with inserted cutting aid.

FIG. 10 shows that four different containers 12.6 to 12.9 can be stacked one on top of the other in this manner, the contents of the lower container in each case remaining identifiable. From the symmetrical arrangements shown in FIG. 10, it could be seen that, for example, the smallest container 12.6 could also be placed on the container 12.8 in addition to the container 12.7, but that the possibility also exists of arranging a second container 12.6 on the container 12.7 or on the container 12.8. Similarly, a second container with the dimensions of the container 12.7 could also be placed on the container 12.6. Furthermore, a further container 12.7, following the container 12.8, could be placed on the container 12.9, or two containers 12.6 are placed on the container 12.9 and then follow the container 12.8. The arrangement of the crenellations permits these widely varying possibilities.

As mentioned above, the underlay 9 should be adapted, for example, to a drawer. It is therefore necessary, in many enforced cases, for the underlay 9 to be cut to size. A very simply designed cutting aid 25 is provided for this purpose. This consists of a strip 26 having a width b which corresponds to a distance a between two pegs 11. As a result of this design, the strip 26 can be pushed between a row of pegs 11, as is indicated by the arrow x.

A slit 27 is formed in the strip 26, into which slit, for example, a knife can be inserted. The knife is thus guided by the strip 26 and passes in a straight line between the pegs 11.

After the underlay 9 has been scored with the knife, the strip to be cut off is broken off from the underlay 9.

Figure 12:
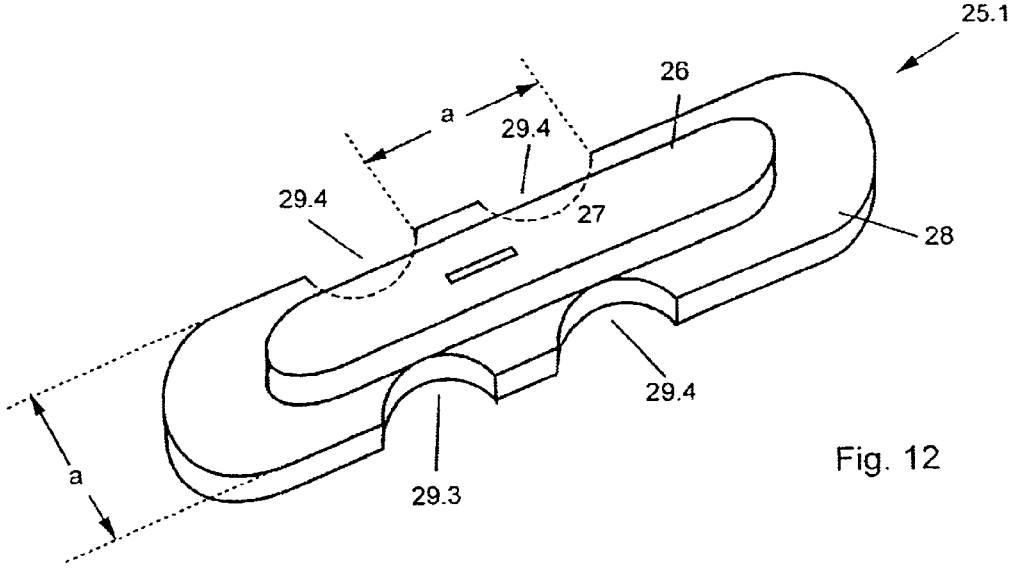
FIG. 12 shows a perspective view of a further example of embodiment of a cutting aid.
Figure 13:
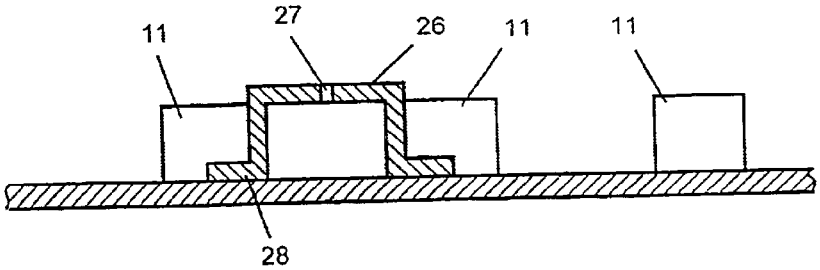
FIG. 13 shows a partial cross-section through an underlay according to the invention with inserted cutting aid is a template for sizing parts.
Figure 14:
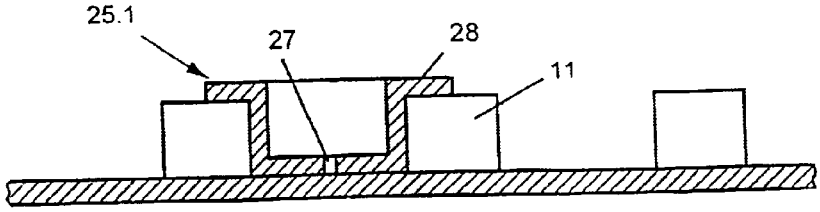
FIG. 14 shows a partial cross-section through an underlay according to the invention with inserted cutting aid in a different position of use from FIG. 13.
Figure 15:
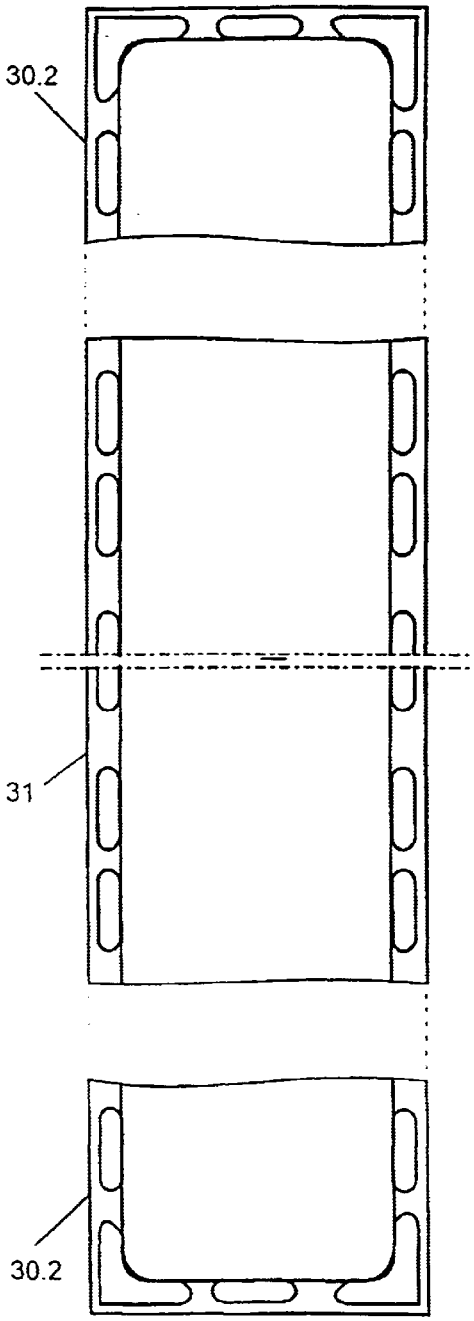
FIG. 15 shows a plan view of a further example of embodiment of a container according to the invention in an exploded view.

In a preferred example of embodiment of the invention according to FIGS. 12 to 14, a cutting aid 25.1 is simultaneously also designed as a template when sizing a strip of an underlay. For this purpose, a cover strip 28 is placed on the strip 26 and possesses marginal centering depressions 29.1 to 29.4 whose distance apart corresponds to the distance a between the pegs 11.

If an additional underlay strip is now placed on an underlay 9 to fill out, for example, a drawer, the connecting point between underlay and additional strip can be bridged by the cutting aid 25, as is indicated in FIG. 13. In this case, the corresponding pegs 11 engage into the centering depressions 29.1 to 29.3. The actual securing of underlay 9 and connecting strip is preferably provided by adhesive sticks or the like.

Should the cutting aid 25.1 be subsequently used again as an actual cutting aid, the cutting aid 25.1 is twisted, the height of the strip 26 being selected so that the cover strip 28 passes over the pegs 11.

For long articles, such as, for example, rods, shafts, drills or the like, it has proven advisable to develop a container 12.10 which consists of at least three parts. Two end pieces 30.1 and 30.2, which are open on one side, receive a middle piece 31 between them which is open on both sides.

Furthermore, as many middle pieces 31 as desired or a middle piece 31 of a specific length may be provided between the two end pieces 30.1 and 30.2.

Figure 17:
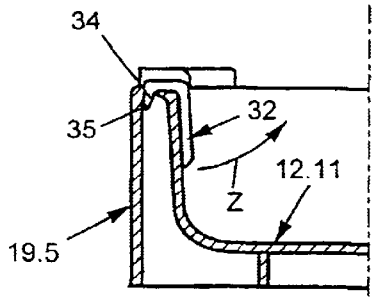
FIG. 17 shows a cross-section through the container according to FIG. 16 along the line XVII—XVII.
Figure 16:
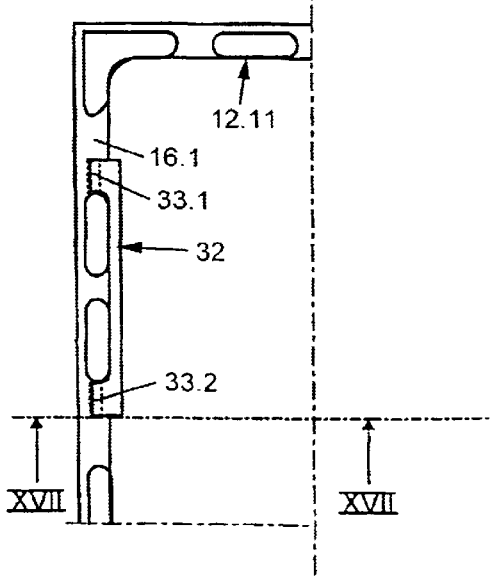
FIG. 16 shows a plan view of one part of a further example of embodiment of a container according to the invention with an indicator.

DE 296 02 136.9 has disclosed a wear indicator relating to a tool located in a container. This concept can also be adapted to the present invention. For this purpose, according to FIGS. 16 and 17, a plate 32 is connected to a container 12.11. This plate 32 can be attached internally or externally to the container 12.11. In a preferred example of embodiment, the plate 32 is suspended in a side wall 19.5 of the container 12.11. For this purpose, two slits 33.1 and 33.2 are formed in an upper marginal edge 16.1, the plate 32 engaging by means of a hook-shaped extension 34 into the slit 33.1 or 33.2. The hook-shaped extension 34 preferably possesses a barb 35 by which it is anchored in the slit 33.1 or 33.2. In addition, a predetermined breaking point may be provided close to the extension 34. If the plate 32 is to be removed, it is raised upward in the direction z, so that the predetermined breaking point breaks and the extension 34 is released from the plate 32.

The plate 32 may possess a wear indicator, as mentioned above. However, any desired inscription is also possible.

The figures do not show the fact that the containers 12 to 12.11 may also be provided with lids. These lids may have a similar shape to a positioned container, but are designed to be much less deep. It is also possible, however, for the containers 12 to 12.11 to be sealed, for example after the insertion of tools, with a film or similar skin which is removed from the container only before use of the tools. Many possibilities are conceivable here and are to be encompassed by the invention.

What is claimed is:

1. A box for storing articles comprises: a housing; at least one drawer slidably received in the housing, the drawer has a base for support articles to be stored wherein the base is provided with a plurality of base securing means wherein the plurality of base securing means are provided on an underlay which is fitted on the base of the drawer; and at least one container for receiving articles to be stored, the said at least one container has a bottom wherein an underside surface of the bottom is provided with bottom securing means which interacts with at least some of the base securing means for holding the container in a fixed position of the base of the drawer wherein the container has side walls with upper marginal edges on which crenellation-like projections are arranged for receiving another container placed thereon.

2. The box according to claim 1, wherein the bottom securing means comprises projections which project downward and engage into the plurality of base securing means which comprises recesses.

3. The box according to claim 2, wherein the projections and recesses are arranged evenly spaced.

4. The box according to claim 2, wherein the projections projecting downwards from the bottom are annular and disappear between the sidewalls.

5. The box according to claim 1, wherein the container consists of a plurality of parts.

6. The box according to claim 1, wherein the container includes one of recesses and projections on a sidewall surface which interact with one of projections and recesses of a second container.

7. The box according to claim 6, wherein the projections are elongated.

8. The box according to claim 1, wherein the projections are angular on the corner regions of the container.

9. The box according to claim 8, wherein at least two further projections are arranged on a side wall marginal between the projections and the corner regions.

10. The box according to claim 9, wherein the distance between the two further projections is less than the distance between them and the projections on the corner regions.

11. The box according to claim 1, wherein the underlay consists of a flexible material which can be rolled up.

12. The box according to claim 1, wherein the underlay consists of a plate-shaped element.

13. The box according to claim 1, wherein the bottom securing means comprises recesses and engage into the plurality of base securing means which comprises projections projecting upward from the base.

14. The box according to claim 13, wherein the projections and recesses are evenly spaced.

15. The box according to claim 1, wherein the plurality of base securing means comprises pegs arranged with uniform spacing on the base and the bottom securing means comprises pegs projecting downwards from the container bottom, wherein the pegs of one of the base and bottom have a uniform spacing a distance apart (a) which is less than the peg diameter of the pegs on the other of the base and bottom for securing the container to the drawer.

* * * * *